United States Patent [19]

Koch et al.

[11] Patent Number: 4,477,073

[45] Date of Patent: Oct. 16, 1984

[54] EXERCISE DEVICE FOR BOARDSAILING

[76] Inventors: Richard K. Koch; Patricia Koch, both of 923 30th St., San Pedro, Calif. 90731

[21] Appl. No.: 378,758

[22] Filed: May 17, 1982

Related U.S. Application Data

[63] Continuation-in-part of Ser. No. 334,733, Dec. 28, 1981, abandoned.

[51] Int. Cl.[3] ..... A63B 7/00

[52] U.S. Cl. ..... 272/93; 272/125; 272/136; 272/900

[58] Field of Search ..... 272/136, 125, 142, 116, 272/143, 93, DIG. 4, 900, 118, 62; 128/25 R; 224/258

[56] References Cited

U.S. PATENT DOCUMENTS

| | | | |
|---|---|---|---|
| 588,017 | 8/1897 | Sandow | 272/136 |
| 1,517,147 | 11/1924 | Barnett | 272/136 X |
| 1,665,745 | 4/1928 | Lang | 224/258 |
| 2,637,555 | 5/1953 | Klaudt | 272/62 |
| 2,919,134 | 12/1959 | Zuro | 272/62 X |
| 3,226,115 | 12/1965 | Underhill . | |
| 3,792,860 | 2/1974 | Selnes . | |
| 3,825,252 | 7/1974 | Geiger | 272/136 |
| 4,059,265 | 11/1977 | Wieder . | |
| 4,077,403 | 3/1978 | Steele . | |

FOREIGN PATENT DOCUMENTS

| | | | |
|---|---|---|---|
| 2756085 | 6/1979 | Fed. Rep. of Germany | 272/93 |
| 677775 | 8/1952 | United Kingdom | 272/125 |

*Primary Examiner*—Richard J. Apley
*Assistant Examiner*—William R. Browne
*Attorney, Agent, or Firm*—Lyon & Lyon

[57] ABSTRACT

Disclosed herein is an exercise device which simulates the conditions of boardsailing and develops the particular body muscles used in boardsailing. The device has a curvilinear boom, a first tension line secured adjacent the extended ends of the boom, a tension transmission member adjustably secured to the first tension line intermediary of the ends thereof, a second line, one end of the second line being secured to the tension transmission member and the other end being adapted to be secured to an anchor member, and an adjustment plate carried by the second line for varying the distance between the tension transmission member and the anchor member.

9 Claims, 16 Drawing Figures

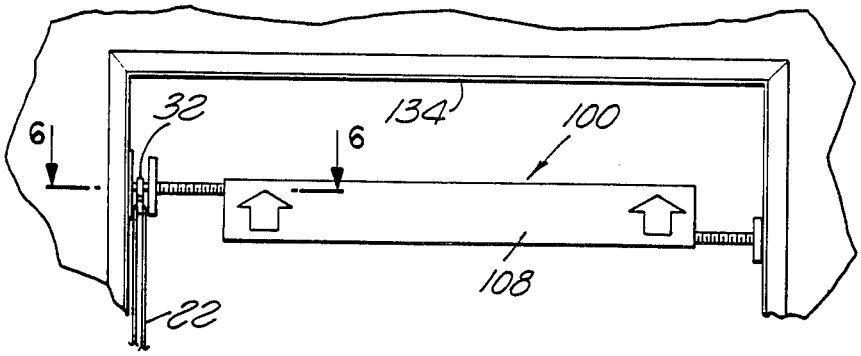
FIG. 4
FIG. 7
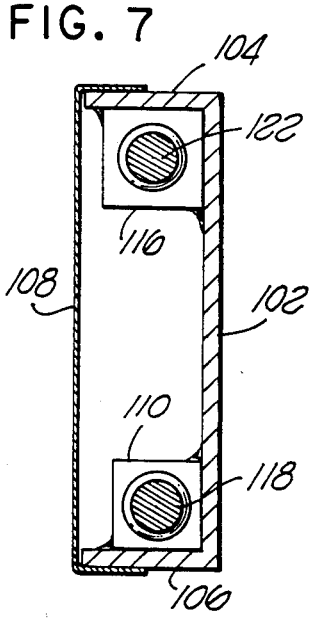
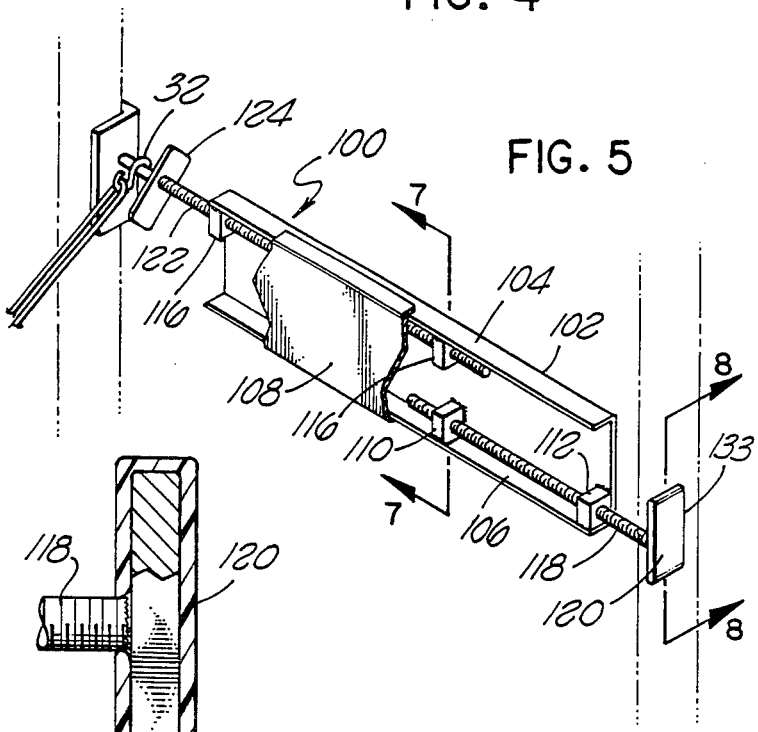
FIG. 5
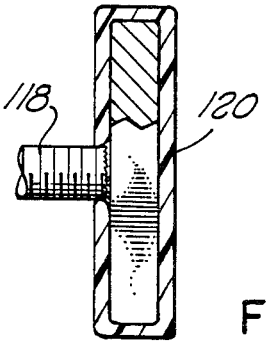
FIG. 8
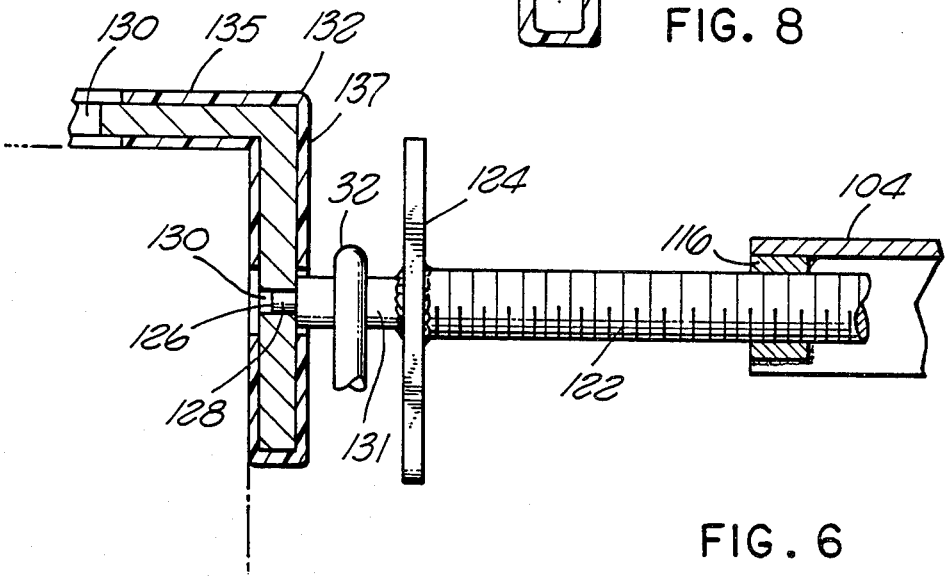
FIG. 6

EXERCISE DEVICE FOR BOARDSAILING

BACKGROUND OF THE INVENTION

This is a continuation-in-part of the parent application Ser. No. 334,733 filed Dec. 28, 1981 entitled "Exercise Device for Boardsailing", now abandoned.

Recent years have seen the creation and rapid widespread growth of a new sport called boardsailing. Unlike conventional sailing where the sailor is generally seated while handling the tiller and the line, in boardsailing, the sailor is always standing and holds directly onto a particularly configured boom. The sailboard used in boardsailing is similar to a surfboard and is provided with a mast, sail and a double-bowed boom which is gripped by the sailor and manipulated by the sailor to maneuver the sailboard.

In a heavy wind, the sail of a sailboard leans into the wind, not away from the wind as in a conventional sailboat. Accordingly, the sailor must lean out from the boom while literally hanging onto and supporting his weight from the boom. Again, this is a rather awkward body position. A complete description of a sailboard is found in U.S. Pat. No. 3,487,800.

In maneuvering the sailboard, the sailor while gripping the boom with both hands, uses his weight and different body positions to pull against the boom. Depending on the strength and orientation of the wind and the course, several different body positions are employed which can exert different muscles from the hands down to the toes so that the body can transmit the necessary directional forces between the boom and the board. For example, while sailing on a close reach in a light wind, the boom is held close to the body for long periods of time while the sailor's toes continually exert pressure against the board. Given the limited space available on the sailboard for such handling, the resultant body position is unnatural and strenuous.

As is apparent, the proper handling of a sailboard requires the use and exertion of numerous different muscles in a manner not found in other sports or areas of physical activity. Because of the unusual body positions and muscles used in boardsailing, particularly in competitive boardsailing, no exercise devices are currently available for conditioning of those muscles. Accordingly, proper conditioning for boardsailing can only be achieved while boardsailing. The disadvantages of such a situation are obvious and are becoming more acute with the continued growth of boardsailing as evidenced by its proposed inclusion in the 1984 Summer Olympiad. It would therefore be highly desirable to develop a training device which provides the exercises necessary to condition the particular muscles used in boardsailing and thereby not only significantly enhance the training abilities of competitive boardsailors but assist even novices in the development of the muscles necessary to handle a sailboard thereby increasing both the enjoyment and the safety of the sport. Such a device is disclosed herein.

SUMMARY OF THE INVENTION

Briefly, the invention comprises an exercise device which simulates the conditions of boardsailing for the development of the muscles used in boardsailing. The device includes a curvilinear or bowed boom similar to that found on a sailboard and means for securing the boom to a fixed yet adjustable elevated tension transmission point in such a manner so that the boom can be pulled upon by the user in several different angles of tension to simulate the same angular pull experienced while boardsailing and thereby provide both isometric and dynamic exercises which develop the particular muscles used while boardsailing.

It is the principal object of the present invention to provide an exercise device for conditioning the muscles used in the sport of boardsailing.

It is another object of the present invention to provide an exercise device for developing the particular muscles used in the sport of boardsailing which simulates the actual boardsailing conditions and body positions.

It is yet another object of the present invention to provide an exercise device for developing the particular muscles used in the sport of boardsailing which is adaptable for portable and adaptable for both indoor and outdoor use.

It is a still further object of the present invention to provide an exercise device for developing the particular muscles used in the sport of boardsailing which is of simple construction and economical to manufacture.

These and other objects and advantages of the present invention will become apparent from the following detailed description taken in conjunction with the accompanying drawings.

BRIEF DESCRIPTION OF THE DRAWINGS

FIG. 4 is a frontal view of the door jamb support of the present invention.

FIG. 5 is a perspective view of the door jamb support with a portion of the cover broken away.

FIG. 6 is an enlarged partial view, partially in section, of one end of the door jamb support.

FIG. 7 is an enlarged sectional view taken along lines 7—7 in FIG. 5.

FIG. 8 is an enlarged sectional view taken along line 8—8 in FIG. 5.

DESCRIPTION OF THE PREFERRED EMBODIMENT

Figure 2:
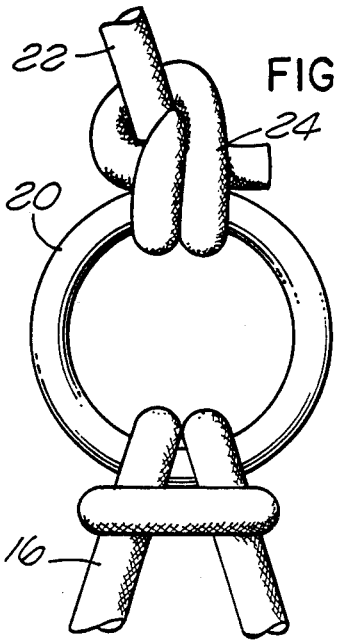
FIG. 2 is a plan view of the tension transmission ring secured to the lines.

Referring now in detail to the drawings, the exercise device 10 of the present invention is comprised of a curvilinear or bowed boom 12 which is preferably constructed of steel tubing covered with neoprene and simulates one side of the double-bowed boom on an actual sailboard (not shown). Protective caps 14 are provided on each end of the boom 12. A first tension transmission line 16, preferably constructed of nylon, is releasably secured at each of its ends to the boom adjacent the extended ends thereof. A tension transmission annulus or ring 20, also preferably constructed of steel, is secured to line 16 intermediary of its ends by a lark's head knot as seen in FIG. 2. As will be discussed later herein, this securement of the annulus to the line allows the ring to be securely positioned at any desired location between the ends of line 16 to provide an adjustable tension transmitter for varying the angular disposition of the tension force transmission lines L-1 and L-2 and thereby simulate the different actual pulls on a boardsail boom during sailing.

Figure 9A:
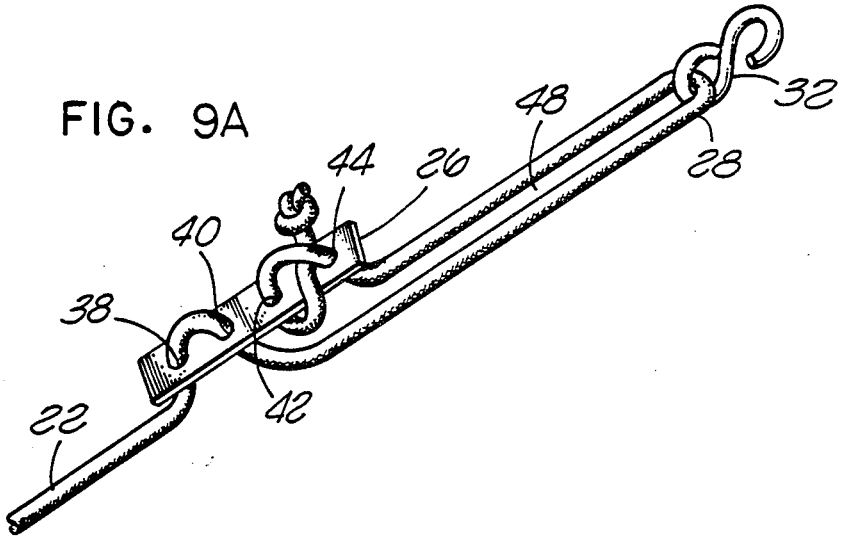
FIG. 9A–9C are perspective views of the adjustment plate illustrating the use thereof.

A second line 22 is tied at one end 24 to the tension transmission ring 20 as seen in FIG. 2 and extends therefrom through an adjustment bracket 26, is looped back upon itself at its extended end 28 and is secured to the bracket as shown in FIG. 9A. An "S"-shaped steel hook 32 is looped through the extended end 28 of line 22 for securement of the line to a permanent anchor 24 as seen in FIG. 1, or a door mounting assembly 100 as seen in FIGS. 4 and 5, or other suitable stationary support.

Figure 9B:
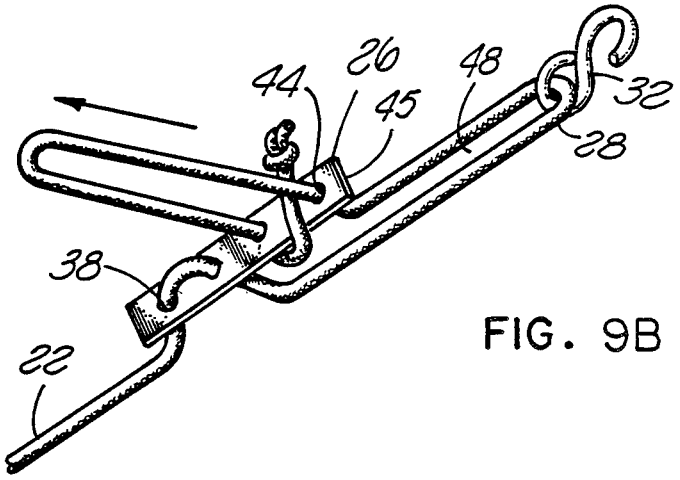
Figure 9C:
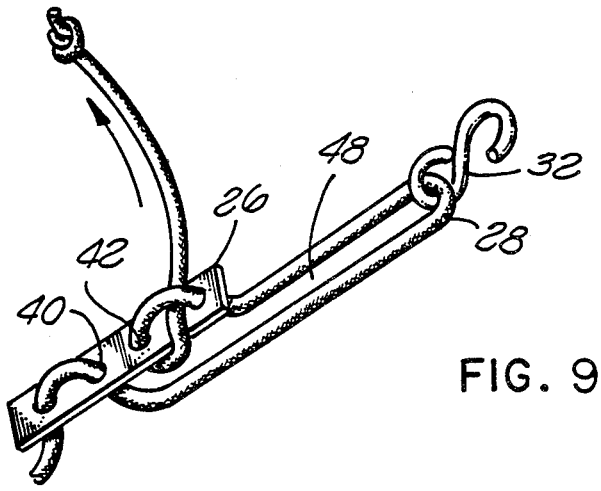

The adjustment bracket 26 is best shown in FIGS. 9A–9C. As seen therein, the bracket is provided with four aligned apertures 38, 40, 42 and 44 so that line 22 can extend through aperture 38 from one side of bracket 26 to the other, back through aperture 40 and outwardly from the end 45 of bracket 26 where line 22 is bent back upon itself to form a loop 48. The line is then directed through aperture 42 in bracket 26, back through aperture 44 and under itself (See FIG. 9A) thereby securing the line to the bracket and setting the distance between ring 20 and hook 32. To shorten this distance for different exercises or to accommodate anchor 24 of different elevations a portion of line 22 is pulled through aperture 44 (FIG. 9B) and then through aperture 42 and pulled tight (FIG. 9C) thereby shortening the length of loop 48 defined by line 22 and accordingly shortening the distance between ring 20 and hook 32.

Figure 1:
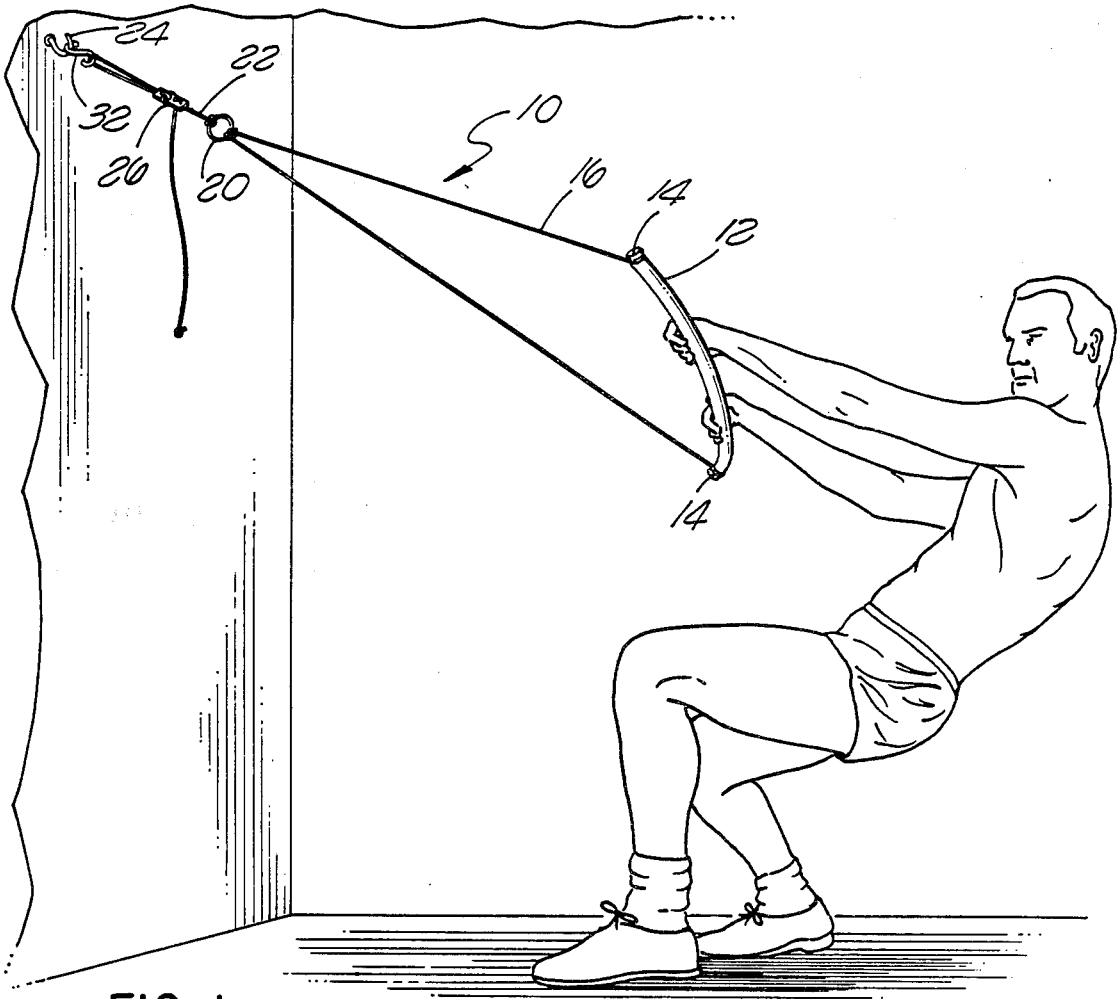
FIG. 1 is a perspective view of the exercise device of the present invention shown in use.
Figure 3:
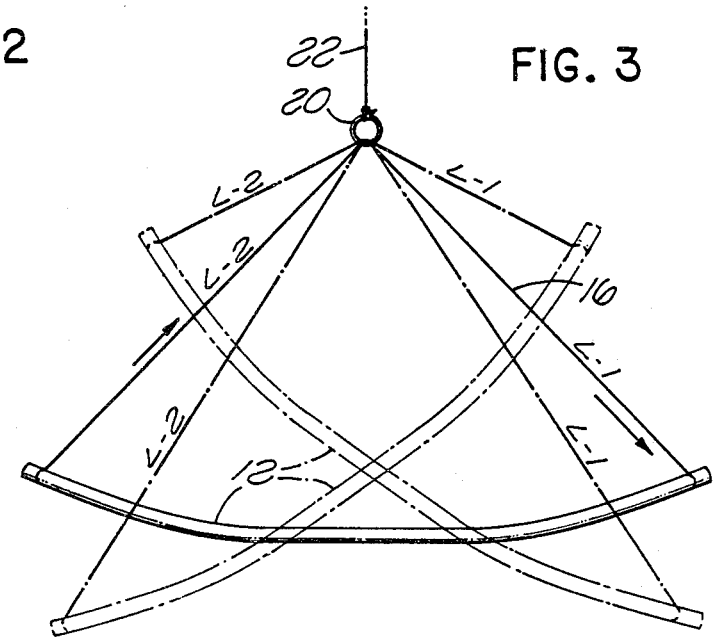
FIG. 3 is a plan view of the boom, tension transmission ring and lines illustrating different angles of tension transmission resulting from varying the location of the tension transmission ring along the tension line.

In the embodiment of the invention of FIGS. 1 and 3, the "S"-shaped hook 32 which is secured to loop 48 of line 22 is fastened to an anchor hook or ring 24 which is fixed at a desired height in a wall or the like. With the device 10 secured as described above and the length of line 22 suitably adjusted, the boom 12 can be gripped by an individual as illustrated in FIG. 1 for isometric or dynamic exercises in different body positions corresponding to the positions used in boardsailing. As the angular orientation of the boom and the position of the sailor's hands on the boom change during sailing in response to the strength of the wind and the orientation of the sailboard with respect to the wind direction, so does the direction of the pull on the boom with respect to the body. To assimilate such changes into device 10, the tension transmission annulus or ring 20 is affixed to line 14 such that while it is held securely in place, its location on line 16 can be varied by slacking line 16, loosening the knot and moving the ring and when tension is again applied to the line by pulling on the boom, the ring 20 is held in place in the new location. Accordingly, by adjusting the position of the ring along line 16 as illustrated in FIG. 3, the length of the generated tension force transmission lines L-1 and L-2 are varied as are the angles of incidence of those lines with respect to the boom. By properly positioning the tension transmission ring along line 16, this angular disposition can be adjusted to simulate the same angular pull which is experienced during boardsailing when executing a different sailing maneuver. Through such adjustability, the exercise 10 can reproduce the different angles of pull experienced during boardsailing and through isometric exercise with these different adjustments, the user can exercise each of these muscles in the same manner as they would be exerted during boardsailing.

FIGS. 4–8 illustrate a version of the exercise device 10 wherein the device is adapted for use in doorways when a permanent anchor is not available. For such use, a doorway support assembly 100 which is adapted to extend across the doorway and bear against the opposite sides of the door jamb. The assembly comprises elongated support bracket 102 defining upper and lower elongated flanges 104 and 106 and a cover plate 108 which is welded or otherwise affixed thereto. Threaded nuts 110 and 112 are welded to the lower flange 106 toward one end thereof and threaded nuts 114 and 116 are welded to the upper flange 104 toward the other end of the support bracket 102 as best seen in FIG. 5. A first threaded rod 118 having a friction pad 120 secured to the extended end thereof is in threaded engagement with secured nuts 110 and 112. A second threaded rod 122 having a handle 124 welded or otherwise permanently affixed thereto adjacent one end of rod 122 is threadably engaged with secured nuts 114 and 116. The extended end 126 of upper rod 118 is provided with a non-threaded portion 131 externally adjacent handle 124 to accommodate the "S"-shaped hook 32 extending from line 22 and a reduced diameter portion 128 which is adapted to be received in aperture 130 in an L-shaped door jamb friction bracket 132. To provide versatility in mounting, the L-shaped friction bracket 132 has legs 135 and 137 of different lengths, each being provided with an aperture 130. In this manner, door jambs of different configurations can be accommodated. If desired, more than one mounting aperture 130 can be provided in each leg of the friction bracket 132 to further increase the mounting versatility of the assembly.

By way of example, nuts 110 and 112 are ⅜ inch nuts to accommodate ⅜ inch rod 118. Nuts 114 and 116 are 7/16 inch to accommodate rod 122 which is 7/16 inches in diameter. Bracket 102 is preferably constructed of steel but could also be constructed of high strength plastic. Friction pad 120 and friction bracket 132 are vinyl coated steel plates.

In use, the support bracket is placed between the door jambs spaced slightly from the upper transverse beam 134 and the friction pad 120 is rotated until it abuts one side of the door jamb. The L-shaped friction bracket 132 is placed against the other door jamb with the extended portion 135 being on the opposite side of the doorway from the exerciser. The reduced diameter end portion 128 of the upper rod 122 is placed into the aperture 130 in the friction bracket 132. The handle 124 which is secured to the upper rod is then rotated causing the upper rod 122 to extend further from the bracket 102, pressing the L-shaped friction bracket 132 against one side of the door jamb and the friction pad 120 on rod 118 against the other side of the door jamb. In this manner, the assembly is held securely in place. By elevating rod 122 above rod 118, rotation of the assembly about the end 133 thereof in the door jamb, which might otherwise tend to occur during exercise, is prevented, thereby increasing the safety of the device. This results from the fact that with such a difference in elevation of the rods such rotation would tend to increase the effective length of the overall assembly which is prevented from occurring by the door jamb and in fact results in greater pressure being exerted by the assembly on the door jamb, further strengthening the installation of the assembly.

In an alternate embodiment of the door jamb mounting assembly, the cover plate 108 extends above the upper flange 104 so that the upper surface of the cover plate can in fact bear against the upper surface of the transverse beam of the door jamb and thereby increase the stability of the assembly and reduce the chance of any inadvertent upward dislodging of the assembly from the door jamb during use. If desired, a pair of suction cups (not shown) could be attached to the upper surface of the cover plate to hold the cover plate to the beam and thereby facilitate installation of the door jamb mounting assembly.

In yet another embodiment of the invention, a spring assembly 200 is provided between the transmission ring 20 and line 22 and secured to line 22 by a hook 202 or other suitable fastening means. It has been found that the inclusion of the spring assembly provides the exercise device 10 with a resilient action which even more closely duplicates the movements and exertion on the body experienced while boardsailing.

Figure 11:
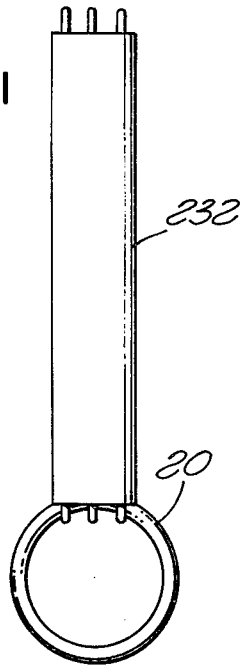
FIG. 11 is a plan view of the spring assembly.
Figure 10:
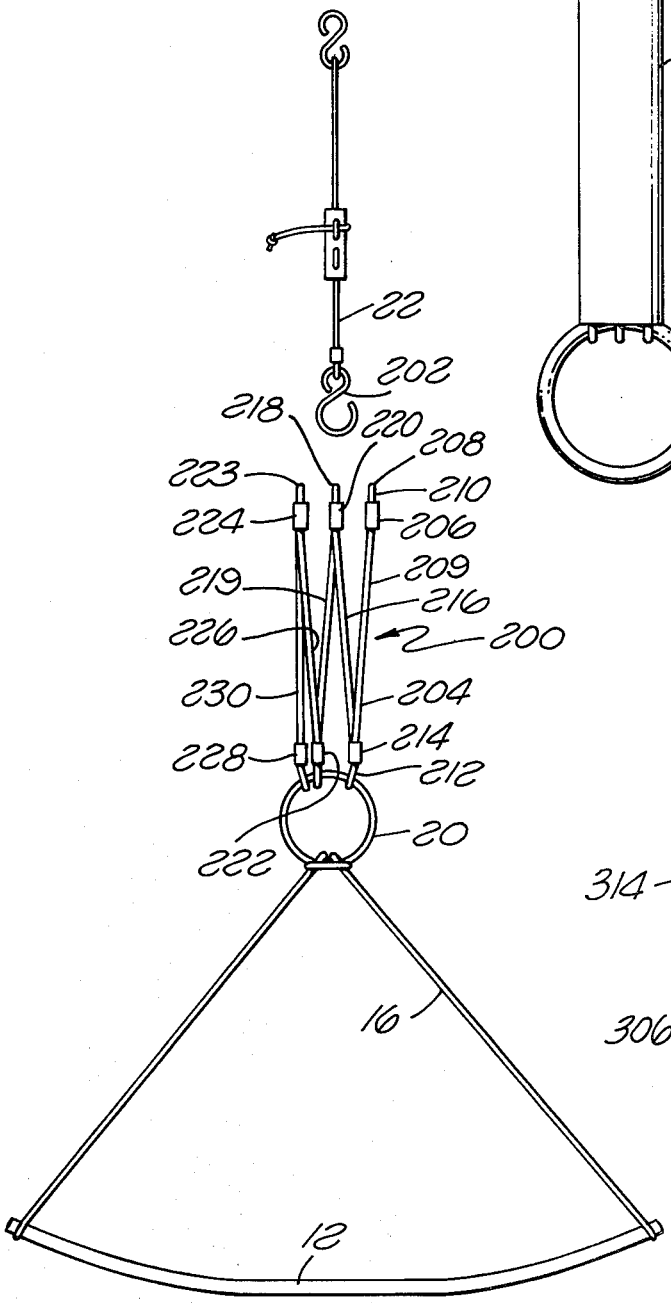
FIG. 10 is a plan view of the boom, tension transmission ring, lines and adjustable spring assembly.

FIGS. 10 and 11 illustrate one embodiment of the spring assembly. As seen therein, the spring assembly 200 is comprised of an elastic shock cord 204 often referred to as a bungee cord. As seen therein, one end 208 of the cord is bent back upon itself to define an extended loop 210 which is secured by a suitable clamp 206. The cord then extends from end 208 to define a first spring length 209 and about the tension transmission ring 20 to define loop 212 and is secured by a second clamp 214. The cord 204 then extends outwardly from clamp 214 to define a second spring length 216 and an extended loop 218 which is secured by clamp 220. The cord then returns about tension transmission ring 20 to define a spring length 219, loops about the tension transmission ring at 220, is affixed by clamp 222 and extends to a final terminal loop 223 which is secured by clamp 224, thereby defining spring length 226. The cord then extends back about the transmission ring 20 and is secured by a final clamp 228, defining spring length 230.

In use, depending upon the weight of the user, one or more of the terminal loops 210, 218 and/or 222 are secured to hook 202 thereby selecting the desired spring tension. It has been found that with a ⅜ inch diameter high density shock cord, a person weighing from 0 to 60 pounds would secure only loop 210 about hook 202 thereby employing only a single spring length 209. If a person weighed from 60 to 100 pounds, the center loop 218 would be secured about the hook to provide the double strength spring tension provided by cord lengths 216 and 219. From 100 to 140 pounds, loops 210 and 218 would be employed, and from 140 to 180 pounds, loops 218 and 222 would be utilized to provide four lengths of spring tension. A person weighing from about 180 to 220 pounds would secure all three extended loops 210, 218 and 222 about hook 204. For persons weighing over 220 pounds, additional loops could be provided by a longer elastic shock cord. It is to be understood that the various spring tensions provided by cord 204 may vary with cord manufacture and some experimentation may be required to determine the best spring tension for a given weight. But by the aforesaid spring assembly 200 several different spring tensions are available to the user to better simulate different boardsailing conditions for persons of different weights and strengths.

In the preferred embodiment of the invention, the spring assembly 200 is encased in a sheath 232 as seen in FIG. 11 to keep the unused loops of cord from flailing about during exercise. If the user should not wish to use the spring assembly 200 with the exercising device 10, it is only necessary to hook the tension transmission ring directly onto the hook member 202 and the device can be operated as described above at length.

Figure 12:
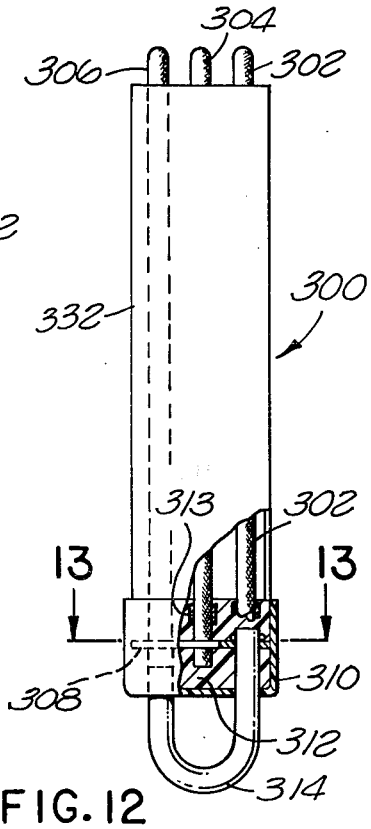
FIG. 12 is a partial sectional view of a second embodiment of the spring assembly.
Figure 13:
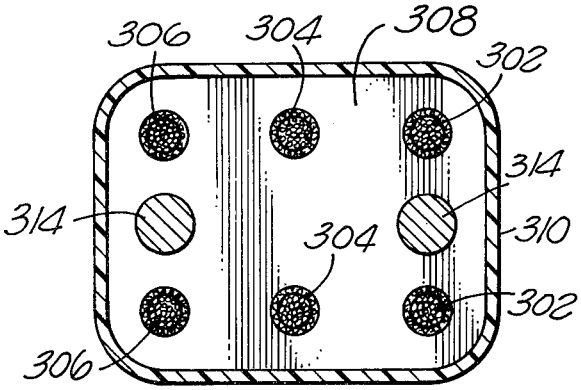
FIG. 13 is a sectional view taken along line 13—13 in FIG. 12.

FIGS. 12 and 13 illustrate a second embodiment of a spring assembly 300. Spring assembly 300 is comprised of two lengths of high density elastic shock cord 302 and 306, and one length of standard density shock cord 304. Each length of cord is bent back upon itself to define three elongated loops with the ends of the cords extending through three pairs of aligned apertures in a plate 308. While the plate 308 serves to properly align and position the lengths of shock cord, the ends of the cord are secured in place by means of an open cup 310 which is filled with a resin material 312 as seen in FIG. 12. Additionally, wire clamps 313 are secured about each length of shock cord, compressing each cord tightly. The clamps 313 are attached just below the top surface of the resin as seen in FIG. 12. Without these clamps, the shock cords would decrease in diameter and could pull out of the resin. The wire clamps serve to decrease this diameter of the cords at the points of securement within cup 310 to a greater degree than would otherwise result from stretching under tension. By this means, the resin holds the clamp and the cord compressed, thereby firmly fixing the cords in place. To provide an attachment of the assembly 300 to the tension transmission line 16, a U-shaped tension bracket 314 is provided which extends through apertures in plate 308 and through apertures in the closed end of the cup 210. The bracket 314 is similarly secured in place by the resin 312 thereby defining a tight securement of the tension bracket 314 and elastic shock cords 302, 304 and 306. Bracket 314 is then affixed to the tension transmission line 16 in the same manner as was the tension transmission member 20.

Because bungee or shock cords when looped about the tension transmission ring 20 will tend to weaken at the point at which the cords contact the ring, the cords should preferably be strengthened at the ends of the loops defined by cords 302–306. This can be accomplished by stretching the cords at the ends of these loops to near their maximum extension and dipping the stretched ends in resin which is allowed to set before the tension is released. This process produces loop ends which are permanently stretched and the resin bonds the cord coverings into a rigid container for the compressed rubber. No disintegration will then occur because the rigid container will then absorb the load.

In this second embodiment of the spring assembly 300, the centrally mounted shock cord 304 has approximately one-half the tension strength of cords 302 and 306 to provide the flexibility in the spring assembly 300 found in assembly 200. In utilizing spring assembly 300, a person weighing from 0 to 60 pounds would affix loop 304 about hook 202. A person weighing 60 to 100 pounds would utilize either loop 306 or 302. A person weighing from 140 to 180 pounds would utilize loops 302 and 306 and a person weighing from 180 to 220 would utilize all three loops. For persons weighing over 220, additional shock cords could be provided. A sheath 332 is also provided about the shock cords in assembly 300.

Figure 14:
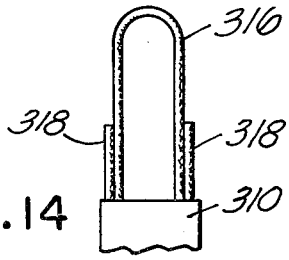
FIG. 14 is a partial plan view of a third embodiment of the spring assembly of the present invention.

FIG. 14 illustrates yet another embodiment which can be employed in spring assembly 300. As seen in FIG. 14 wherein only a single looped shock cord 316 is shown secured within the cup 310, additional lengths of shock cord 318 are cemented to the leg portions of the "U"-shaped loop 316 thereby providing a spring of increasing tension. Such a spring configuration causes initial deformation of the upper portion of the shock cord prior to stretching the lower double thickness portion. This spring configuration duplicates the boardsailing experience of falling free while changing the angle of the boom just prior to the wind catching the sail.

As set forth above, the inclusion of the spring assembly 200 or 300 in the exercising device 10 results in an even greater assimilation of the boardsailing experience than is provided in the embodiment illustrated in FIGS. 1–9C. In addition, rapid response of the spring assemblies 200 and 300 provide what could be termed an inertial balance between the weight of the exerciser and the tension in the shock cords. This balance coupled with the rapid response of the spring assemblies allows one to snap the boom toward or away from himself rapidly without changing his body position which not only provides for excellent general exercise but allows one to practice hooking up to a harness under actual simulated sailing conditions.

Various changes and modifications may be made in carrying out the present invention without departing from the spirit and scope thereof. Insofar as these changes and modifications are within the purview of the appended claims, they are to be considered as part of the invention.

I claim:

1. An exercise device adapted to be secured to a fixed anchor support for developing the muscles used while boardsailing, said device comprising: an elongated gripping bar; a first flexible tension line secured to said bar adjacent the ends thereof; a second flexible tension line; a tension transmission member secured to and extending between one end of said second flexible tension line and said first flexible tension line at a location intermediary of the ends of said first flexible tension line, said means being adjustable along the length of said first flexible tension line; means for securing said second flexible tension line to a fixed anchor support; and a spring assembly adapted to be secured to and disposed between said first and second tension lines, said assembly comprising a length of elastic shock cord, said length of cord being bent back and forth upon itself and about said tension transmission member to define a first plurality of extended loops adapted to be secured to said second flexible transmission line and a second plurality of loops disposed about said tension transmission member and means for maintaining said loops in said cord.

2. An exercise device adapted to be secured to a fixed anchor support for developing the muscles used while boardsailing, said device comprising: an elongated gripping bar; a first flexible tension line secured to said bar adjacent the ends thereof; a second flexible tension line; a tension transmission member secured to and extending between one end of said second flexible tension line and said first flexible tension line at a location intermediary of the ends of said first flexible tension line, said means being adjustable along the length of said first flexible tension line; means for securing said second flexible tension line to a fixed anchor support; a spring assembly adapted to be secured to and disposed between said first and second transmission lines, said assembly comprising a plurality of lengths of elastic shock cord, each of said lengths being bent back upon itself to define a corresponding plurality of elastic loops, means for securing the extended end of said lengths of shock cord to maintain said loops and said tension transmission member being secured to and carried by said securing means.

3. The combination of claim 2 wherein one of said lengths of elastic shock cord has a spring strength equal to approximately one-half of the spring strengths of the remaining lengths of elastic shock cords.

4. An exerciser device adapted to be secured to a fixed support for developing the muscles used while boardsailing, said device comprising: a bowed elongated gripping bar having a finite length; a first flexible tension line having a finite length, said line being secured to said bar adjacent the ends thereof, the length of said line being greater than the length of said gripping bar; a second flexible tension line; an annulus secured to and extending between one end of said second flexible tension line and said first flexible tension line at a location intermediary of the end of said first flexible tension line, said annulus being adjustable along the length of said first flexible tension line; means for securing said second flexible tension line to a stationary support such that upon pulling on said bar, said first flexible tension line defines two tension force transmission lines extending from the ends of said bar to said annulus, each of said transmission lines defining angles of incidence with said bar, and upon varying the location of said annulus along said first flexible transmission line, said angles of incidence are varied to simulate different angles of pull experience during boardsailing and thereby developing the different muscles used while boardsailing; and a spring means adapted to be secured to and disposed between said first and second tension lines.

5. The combination of claim 4 including means carried by said second flexible tension line for varying the distance between said annulus and said securing means.

6. The combination of claim 4 including a spring assembly adapted to be secured to and disposed between said first and second tension lines, said assembly comprising a length of elastic shock cord, said length of cord being bent back and forth upon itself and about said annulus to define a first plurality of extended loops adapted to be secured to said second flexible transmission line and a second plurality of loops disposed about said annulus and means for maintaining said loops in said cord.

7. The combination of claim 4 wherein said spring assembly comprises a plurality of lengths of elastic shock cord, each of said lengths being bent back upon itself to define a corresponding plurality of elastic loops, means for securing the extended end of said lengths of shock cord to maintain said loops and said annulus being secured to and carried by said securing means.

8. An exercise device adapted to be secured to a fixed anchor support for developing one's muscles, said device comprising: an elongated gripping bar; a first flexible tension line secured to said bar adjacent the ends thereof; a second flexible tension line; a spring assembly comprising a plurality of lengths of elastic shock cord, each of said lengths being bent back upon itself to define a corresponding plurality of elastic loops, a plate member having a plurality of apertures therein for receiving the lengths of elastic shock cord therethrough, a cup member disposed about said plate and said ends of said lengths of elastic shock cord such that said lengths extend from one end of said cup member; a tension transmission member extending from the other end of said cup member and means disposed within said cup member for securing said plate, said lengths of elastic shock cord and said transmission member within said cup member, one or more of said elastic loops being secured to said second flexible tension line and said first flexible tension line being secured to said tension transmission member at a location intermediary of the ends of said first flexible transmission line; and means for securing said second flexible tension line to a fixed anchor support.

9. The combination of claim 8 wherein one of said lengths of elastic shock cord has a spring force of approximately one-half of the spring force of the other lengths of elastic shock cord.

* * * * *